United States Patent [19]

Smith

[11] Patent Number: 4,967,971

[45] Date of Patent: Nov. 6, 1990

[54] PESTLE AND MORTAR FOR CRUSHING PILLS IN PILL CUPS

[76] Inventor: Kevin R. Smith, 6106 Quail Ave. No., Brooklyn Center, Minn. 55429

[21] Appl. No.: 338,282

[22] Filed: Apr. 14, 1989

[51] Int. Cl.[5] ..... B02C 19/08

[52] U.S. Cl. ..... 241/169; 241/169.2; 241/199.11; 241/DIG. 27

[58] Field of Search ..... 241/168, 169, 169.2, 241/199.11, DIG. 27

[56] References Cited

U.S. PATENT DOCUMENTS

| | | | |
|---|---|---|---|
| 2,631,786 | 3/1953 | Morgan et al. | 241/169 |
| 2,892,595 | 6/1959 | Tupper | 241/168 X |
| 3,915,393 | 10/1975 | Elkins | 241/DIG. 27 X |
| 4,121,775 | 10/1978 | Roseberg et al. | 241/169.2 X |
| 4,209,136 | 6/1980 | Linden et al. | 241/169.2 |
| 4,341,356 | 7/1982 | Hiott et al. | 241/169.2 |

FOREIGN PATENT DOCUMENTS

| | | | |
|---|---|---|---|
| 261263 | 10/1988 | Fed. Rep. of Germany | 241/169.2 |

OTHER PUBLICATIONS

Webster's Third New International Dictionary of the English Language Unabridged; 1971; p. 1472.

The American Heritage Dictionary of the English Language; 1981; p. 855.

*Primary Examiner*—Timothy V. Eley

*Attorney, Agent, or Firm*—Palmatier & Sjoquist

[57] ABSTRACT

The present pestle and mortar for crushing pills in pill cups is tailored to conform to the shape of a pill cup. A conventional frustum-shaped pill cup lines a frustum-shaped receptacle in the mortar to receive a frustum-shaped pill crushing portion of the pestle which is nestable in the pill cup. The frustum-shaped crushing portions of the pestle and mortar distribute pressure over much of the exterior and interior surface areas of a pill cup so that pills may be crushed in even fragile paper pill cups without tearing or otherwise damaging the paper pill cups. Moreover, the pill cup and mortar operate as one piece and the frustum-shaped crushing portion of the pestle substantially seals the interior of the pill cup to prevent pill granules from flying out of the pill cup during a pill crushing operation.

17 Claims, 2 Drawing Sheets

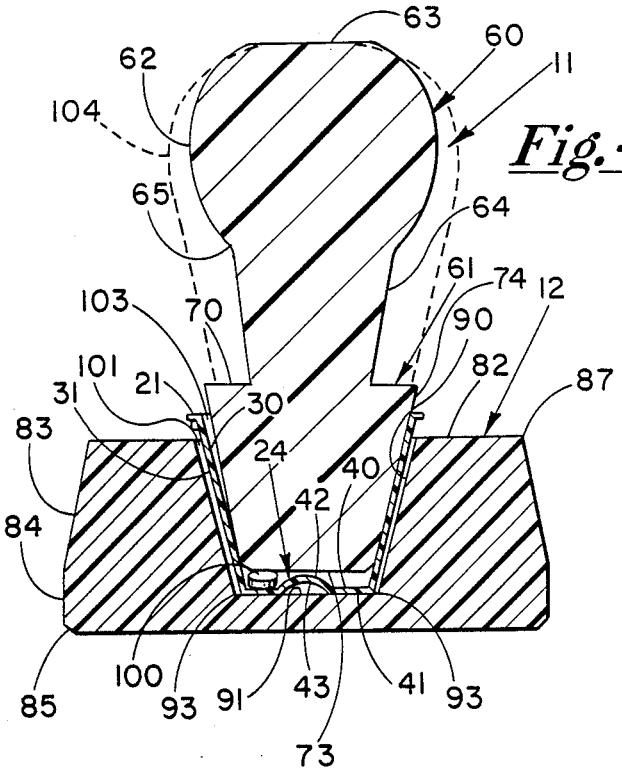
Fig.-3
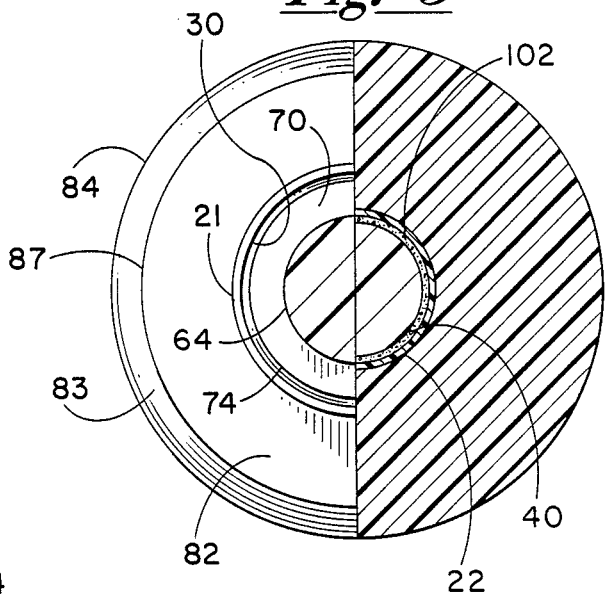
Fig.-5
Fig.-4
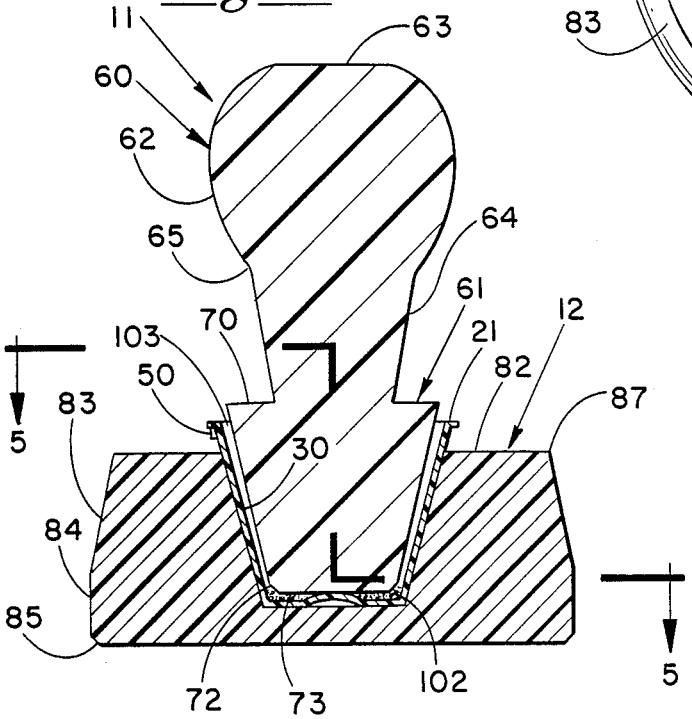

PESTLE AND MORTAR FOR CRUSHING PILLS IN PILL CUPS

The present invention relates to pestles and mortars, and more particularly, to pestles and mortar for crushing pills in pills cups.

BACKGROUND OF THE INVENTION

A pill is crushed to place it in a more suitable form for ingestion. A pill in powdered form may be readily dispersed in water for drinking or easily mixed with a soft food such as applesauce. A crushed pill may also be more rapidly assimilated through the stomach and into the blood stream than a whole pill. Pills that are typically crushed include aspirin and vitamin pills.

A pharmacist may use a conventional pestle and mortar to crush pills. A standard pestle and mortar includes a club-shaped hand tool for the pestle and a bowl-shaped vessel for the mortar. One of the problems with such a pestle and mortar is that pills may jump out of the mortar as pressure is brought to bear on a pill by the pestle. Another problem is that powder tends to stick to the bowl and may need to be scraped out of the bowl to provide an accurate dosage of medication.

When a standard pestle and mortar is not available, one prior art method of crushing pills utilizes a fluted paper pill cup and a tool such as a hammer. A pill to be crushed is placed in the pill cup, the fluted or ruffled sides of the pills cup are folded inwardly and downwardly to cover and contain the pill, and the folded sides of the pill cup are subsequently hit with a hammer-like tool to crush the pill.

The disadvantages of such a pill crushing technique are numerous. For example, paper pill cups are easily torn or perforated by a hammering process. At the very least, a paper pill cup is disfigured by being folded and hammered, and hence a crushed pill must be transferred for ingestion to a second, new and unused pill cup or to another pill dispenser. Furthermore, as the powdered pill is being transferred to another pill dispenser, the torn, perforated, or disfigured paper sides make it difficult to pour the pill powder from the damaged pill cup. Hence, if the powder falls through the perforations or sticks to the disfigured sides, a patient may receive less than his or her proper dosage of medication. Moreover, it is time consuming to properly wrap a pill in a paper pill cup, find a suitable hammering implement and surface for hammering, delicately hammer the pill to a powder, and transfer the powdered pill medication from the flattened pill cup.

Another prior art method includes the use of a pair of spoons. In such a method, a pill to be crushed is placed in the bowl portion of one of the spoons. The underside of the bowl portion of the second spoon is then placed on top of the pill and pushed into the bowl portion of the first spoon so as to crush the pill.

One problem with the spoon crushing method is a loss of the powdered medication over the shallow sides of the spoons. Another problem is that the handles of the spoons provide awkward leverage for the crushing operation and hence a significant amount of strength may be required to break a pill into granules. A further problem is that a spoon holds a relatively small amount of liquid and hence, if a crushed pill is to be dispersed in liquid for ingestion, the pill powder must be transferred to a second, more suitable dispenser.

SUMMARY OF THE INVENTION

A feature of the present invention is a pestle and mortar tailored to conform to the shape of a pill cup.

Another feature of the present invention is a pestle which includes a frustum-like crushing portion to reflect substantially the shape of the interior of a frustum-like pill cup.

Another feature of the present invention is a mortar which includes a frustum-like receptacle formed to receive a frustum-like pill cup.

Another feature of the present invention is the provision in a pill crushing pestle and mortar, of pestle and mortar sidewall cooperating portions and of a mortar floor portion and pestle pill crushing face portion to distribute pill crushing pressure over much of the exterior and interior surface areas of a pill cup so that pills may be crushed under great pressures in even fragile paper pill cups.

Another feature of the present invention is the provision in a pill crushing pestle and mortar, of a mortar which utilizes a pill cup as a lining for a pestle and pill receiving receptacle.

Another feature of the present invention is the provision in a pill crushing pestle and mortar, of a pill cup receptacle in the mortar which is slightly larger than a pill cup to allow an easy insertion and removal of the pill cup relative the mortar, but which bears against and allows substantially no lateral movement of the pill cup when a pill is crushed.

An advantage of the present invention is that a pill is crushed in a pill cup without tearing, perforating, disfiguring, or otherwise damaging the pill cup.

Another advantage of the present invention is that pills are broken into finer granules quickly, simply, easily, and quietly without any loss of medication.

Another advantage is that the present invention is operable with both paper and plastic pill cups.

Another advantage of the present invention is that, when a pill is crushed with pill granules suddenly being pinched or flying apart at high speeds, the pill granules are retained in the pill cup by the frustum-shaped crushing portion of the pestle which acts like a lid to seal off the interior of the pill cup.

Another advantage of the present invention is that a pill cup in which a pill is crushed may also be used as a pill dispenser. After a pill is crushed in a pill cup, the pill cup containing the powdered pill may be filled with water to disperse the powdered medication and used for drinking. Hence, the present invention includes at least one less step than prior art pill preparation methods.

Another advantage is that pill granules crushed in a pill cup by the present invention may be readily transferred from the undamaged pill cup without loss of even the finest granules.

Another advantage of the present invention is that pill cups are received deeply and securely in the massive and stable mortar to preclude tipping of a pill cup and spillage of powdered medication.

Another advantage of the present invention is a small and compact, sanitary, pill crushing pestle and mortar that is easily cleaned. Since the present pestle and mortar includes flat or rounded surfaces with no sharp edges or corners for the collection of dirt or pill powder, it may be readily rinsed clean under a water faucet.

Other advantages of the present invention are that it is simple to manufacture, inexpensive, and formed from a sanitary and massive material such as natural nylon, which is resistant to breakage upon being dropped, and is abrasion and chemical resistant.

BRIEF DESCRIPTION OF THE DRAWINGS

FIG. 3 is a cross-section view at lines 3—3 of FIG. 1, with a pill disposed between the pestle and pill cup.

FIG. 4 is a cross-section view at lines 3—3 of the FIG. 1 showing the pestle and mortar in operation.

FIG. 5 is a cross-section view at lines 5—5 of FIG. 4.

DETAILED DESCRIPTION OF THE PREFERRED EMBODIMENTS

Figure 1:
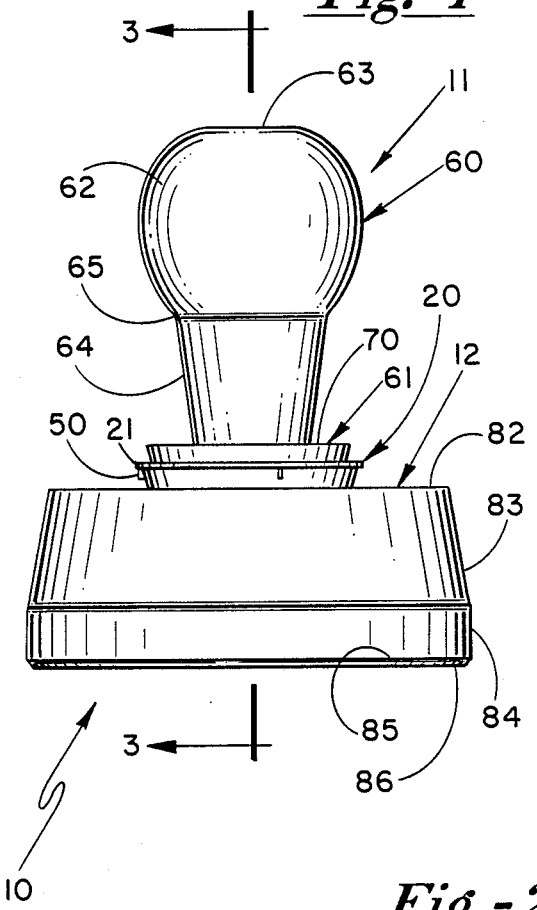
FIG. 1 is a side elevation view of the present pestle and mortar with a pill cup disposed between the pestle and mortar.
Figure 2:
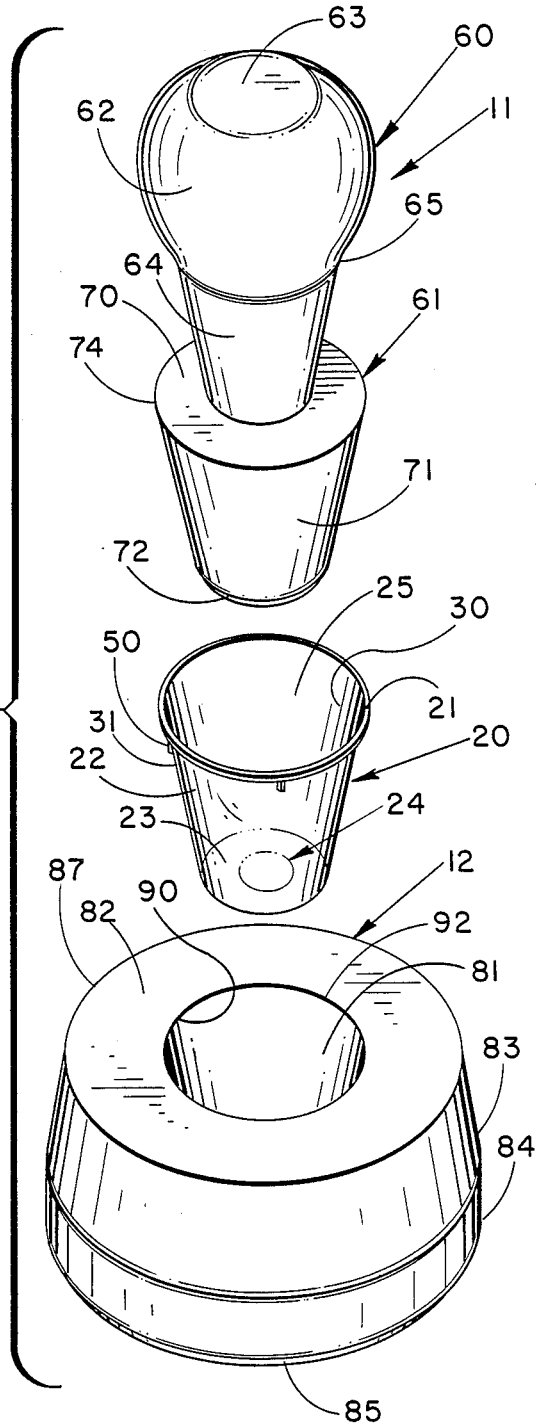
FIG. 2 is an exploded view of the pestle and mortar and pill cup shown in FIG. 1.

As shown in FIGS. 1 and 2, a pestle and mortar is indicated in general by the reference numeral 10. The pestle and mortar 10 includes a pestle 11 and a mortar 12.

As shown in FIGS. 1–4, a standard plastic one ounce frustum-like pill cup 20 may be nestled between the pestle 11 and mortar 12. The frustoconical-like pill cup includes an integral, peripheral boss or lip 21 disposed on the top end of the pill cup 20. A frustum-like continuous or endless sidewall 22 is integrally connected to and extends downwardly and inwardly from the lip 21. A bottom, bottom end or floor 23 is integrally connected to the continuous or endless bottom edge of sidewall 22. As shown by FIGS. 3 and 4, the floor 23 includes an integrally and centrally formed resilient dimple 24. The dimple 24 is convex relative an interior 25 of the pill cup 20. An intersecting edge 26 disposed between the sidewall 22 and the floor 23 is shown to be sharp, but if desired, may be rounded.

The continuous sidewall 22 includes a continuous interior face 30 and a continuous exterior face 31. The interior face 30 may include measurements scored or imprinted therein such as millimeters, cubic centimeters, ounces, drams, or tablespoons, their respective abbreviations and their respective measuring lines. The exterior face 31 may be smooth.

The bottom 23 of the pill cup 20 includes a ring-like interior or top face 40 and a ring-like exterior or bottom face 41. The dimple 24 includes a convex, inside or top face 42 and a concave, exterior or bottom face 43.

Pill cup 20 further includes a set of three nubs 50 equally spaced about the lip 21. Each of the nubs 50 is integrally connected to the lip 21 and a top continuous edge portion of the sidewall 22. One purpose of the nubs 50 may be to facilitate removal of a pill cup 20 from a stack of pill cups.

The pestle 11 includes a handle portion 60 integrally formed with a frustum-like crushing portion 61. The handle portion 60 includes a somewhat ball-shaped, smooth faced top end 62 with a somewhat flat top face 63 and a frustum-like, smooth faced, media portion 64. The ball-shaped end 62 leads gradually into the frustum-like media portion 64 via a continuous, rounded edge portion 65.

The frustum-like crushing portion 61 of the pestle 11 includes a ring-like, planar, smooth, top face 70 disposed substantially parallel to the top face 63 of the ball-shaped portion 62 of the handle 60. The frustum-like crushing portion 61 further includes a continuous or endless, smooth, frustoconical-like sidewall 71 extending from the peripheral edge portion of the ring-like face 70 to a continuous, smooth, beveled, bottom edge 72. The beveled, bottom edge 72 extends inwardly and downwardly from the frustoconical-like sidewall 71 to a flat, planar, circular, smooth, hardened, crushing, bottom face 73. The crushing face 73 is disposed substantially parallel to the faces 70, 63. It should be noted that an intersecting edge 74 disposed between the ring-like top surface 70 and the frustoconical sidewall 71 may be rounded so as to preclude sharp edges which may chip.

It should be noted that the massive frustum-like crushing portion 61 may be somewhat greater than the mass of the ball-shaped portion 62 so as to provide the pestle 11 with a lower center of gravity. The ball-shaped portion 62 may also concentrate much of the mass of the pestle 11 in an upper end so as to concentrate the mass of the pestle 11 in opposing ends and provide a better weight distribution for the pestle 11. It should also be noted that for visual association purposes, two frustum-like portions are provided, one of which is the frustum-like crushing portion 61 and another of which is the frustum-like medial portion 64. The continuous respective sidewall of the frustum-like medial portion 64 may be parallel to the continuous frustoconical-like sidewall 71 to define the angle of sidewall 7!, a portion of which at times may be out of sight within the mortar 12.

The mortar 12 includes a massive, hardened, smooth faced, integrally formed body and a pill cup and pestle receiving receptacle 81 formed centrally therein. The mortar 12 includes a ring-like top face 82 and a round, smooth, tapered, continuous sidewall 83 extending downwardly and outwardly from the ring-like top face 82. A round, smooth, substantially upright, continuous sidewall 84 extends downwardly from the sidewall 83 to a round, smooth, continuous beveled edge 85, which in turn extends inwardly and downwardly to a circular, smooth, bottom face 86. It should be noted that an intersecting edge 87 disposed between the ring-like top surface 82 and tapered sidewall 83 may be rounded to include a radius so as to preclude sharp edges which may chip.

The pill cup and pestle receiving receptacle 81 of the mortar 12 reflects the form of a frustum. The receptacle 81 is formed in part by a tapered, smooth, round, continuous sidewall 90 tapering inwardly and downwardly to a circular, smooth, planar floor 91, which also forms part of the receptacle 81. The planar floor 91 is disposed substantially parallel to the ring-like top surface 82 and bottom surface 86. An intersecting edge 92 disposed between sidewall 90 and ring-like top surface 82 may be rounded to preclude sharp edges which may chip. An intersecting edge portion 93 disposed between the sidewall 90 and the floor 91 is shown to form a sharp angle, but may, if desired, be rounded.

As shown in FIG. 5, the features of the pestle and and mortar 10 are generally round in shape and run parallel to each other. Furthermore, the diameter of the pill crushing bottom face 73 of the crushing portion 61 is slightly less than the diameter of the floor 91. The diameter of the outer edge 74 of the ring-like top surface 70 is also slightly less than the diameter of the pill cup lip 21.

In operation, the pill cup 20 is placed or dropped in the receptacle 81 and subsequently a pill 100 is placed or dropped in the pill cup 20. As the pill 100 is deposited in the pill cup 20, the pill 100 may hit the dimple 24. If the pill 100 hits the dimple 24, the pill 100 typically rolls or falls off of the dimple 24 and onto the ring-like upper surface 40 of the pill cup floor 23.

After the pill cup 20 is deposited in the receptacle 81, a narrow space 101 as shown in FIG. 3 exists between the outer face 31 of the pill cup side wall 22 and the tapering continuous sidewall 90 of the mortar 12 so that the pill cup 20 is slidable, almost imperceptibly to the hand or the eye, from side to side. One of the reasons for the space 101 is to provide for an easy removal of the pill cup 20 from the mortar 12. If space 101 did not exist, a vacuum may be created between the pill cup 20 and the mortar 12 and render removal of the pill cup 20 difficult. It should also be noted that the diameter of the pill cup floor 23 is slightly smaller than the diameter of the inside mortar floor 91.

The receptacle 81 is formed somewhat deeply in the mortar 12 to, in part, provide for a stable mortar for crushing pills. To this end, a large portion of the exterior face 31 of the pill cup sidewall 22 is adjacent to and bearable against substantially all portions of the mortar sidewall 90. As the pill cup 20 rests in the mortar 12, the substantially planar, ring-like bottom face 41 of the pill cup floor 23 bears against the inside floor 91 of the mortar 12, and the pill cup lip 21 and an upper portion of pill cup sidewall 22 are disposed somewhat above the planar top surface 82 of the mortar 12.

After the pill cup 20 has been set in the mortar 12 and contains the pill 100, the pestle 11 is inserted into the pill cup 20. A somewhat downward pressure may be brought to bear on the handle portion 60 as a preliminary step to break up the whole pill 100 into several pieces with the crushing face 73. Subsequently, a downward, circular, rotating, grinding motion may be applied to the ball-shaped portion 62 and the medial handle portion 64 to apply a similar rotating, grinding motion with a crushing face 73 upon the pills pieces to crush the pill 100 into fine granules or powder 102. As the pill 100 is crushed, the pestle sidewall 71 rolls against pill cup sidewall interior surface 30 and thereby brings pressure to bear on a respective portion of the mortar sidewall 90. Hence, pressure on the pill cup sidewall 22 is distributed. Pressure is also distributed about the pill cup floor 23 as the flat surfaces of the pestle crushing face 73 and mortar floor 91 bear or roll simultaneously against respective opposing surfaces of the pill cup floor 23.

As the frustum-like crushing portion 61 is inserted into the interior 25 of the frustum-like pill cup 20, the crushing portion 61 fills up much of the interior 25. When the crushing portion 61 is in the pill cup 20, a narrow space 103 as shown in FIG. 3 exists between the frustoconical sidewall 71 and the interior face 30 of the pill cup 20. One of the reasons for the space 103 is to provide for easy removal of the pestle 11 from the pill cup 20; without such a space 103, a vacuum may be created between the pestle 11 and pill cup 20 to render removal of the pestle 11 difficult and perhaps scatter pill powder 102 out of the pill cup 20. However, the space 103 is sufficiently narrow so that the crushing portion 61 acts like a lid to somewhat seal off the interior 25 of the pill cup 20. As the pill 100 is crushed, the pill pieces or the pill granules 102 may attempt to jump or fly out of the pill cup 20. The crushing portion 61 effectively seals off the pill cup interior 25 to preclude escape by such high speed jumping of the pill pieces or the pill granules 102 as a pill 100 is suddenly crushed.

As the pill 100 is crushed, the crushing end 73 of the pestle 11 may bear against the upper concave surface 42 of the dimple 24. As pressure is brought to bear upon the dimple 24, the dimple 24 may be depressed as shown in FIG. 4 and may expand so as to increase it diameter. As the resilient dimple 24 expands, the pill cup floor 23, which is somewhat resilient, expands and its diameter is increased so as to expand the pill cup sidewall 22, which is somewhat resilient and which in turn bears against the sidewall 90 of the mortar 12. With such an expansion of the dimple 24 and pill cup 20, the pill cup may be precluded from sliding from side to side. Hence, an even greater snug fit or interaction may be provided between the pill cup 20 and mortar 12 so that the pill cup and mortar may act like substantially one piece in a pill crushing operation. The pill cup 20 may also be seen as being a lining for the mortar 12.

It should be noted that the bottom concave surface 43 of the dimple 24 may be depressed to the floor 91 of the mortar 12 without breaking or cracking pill cup 20. After pressure is released from the pestle 11, the resilient dimple 24 returns to an uncompressed, original form, and the pill cup 20 retracts to its original, slightly smaller form.

After the pill 100 has been crushed to pill granules or powder 102, the pestle 11 is simple removed from the pill cup 20. Since the surfaces of the pestle 11, including the crushing end 73, are smooth, little if any pill powder 102 sticks to the pestle 11. Subsequently, the pill cup 20 is removed from the mortar 12 by handling or grabbing the peripherial lip 21. Water or another liquid may be squirted or poured into the pill cup 20 to disperse the pill powder 102 in liquid for ingestion purposes. Alternatively, the pill powder 102 may be poured or transferred to a soft food such as applesauce for ingestion. After the powdered medication 102 has been ingested or transferred from the pill cup 20, the pill cup 20 may be reused.

After a pill crushing operation, the pestle and mortar 10 may be cleaned by rinsing the pestle 11 and mortar 12 under a water faucet. Since the pestle 11 and mortar 12 includes substantially no sharp edges or corners, it is readily cleaned. Once cleaned, the pestle 11 is simply stored in the receptacle 81 of the mortar 12. It should be noted that a wooden-like base with a mortar receptacle has been contemplated Felt-like material affixed to the base surface 86 may preclude a skidding or sliding of the mortar 12, but such a felt-like material may collect dirt and inhibit cleaning of the mortar 12.

It should be noted that the pestle 11 and mortar 12 may be formed from a natural nylon or a natural nylon like material. The natural nylon has low water absorption and is resistant to impacts and breakage such as if it is dropped to the floor. The natural nylon is also resistent to abrasions and chemicals. It may formed from a nylon designated as nylon 6, nylon 6/6, or nylon 6/12. The nylon may have high tensile and compressive strengths. The nylon may include glass strands to improve the tensile and compressive strength and stiffness. It should also be noted that the pestle 11 and mortar 12 may be formed from a stainless steel like metal, glass, or porcelain.

It should also be noted that fluted, frustum-like, paper pill cups may be utilized with the pestle 11 and mortar 12. Such a paper pill cup may include overlapping flutes or ruffles forming a continuous frustoconical-like sidewall for the pill cup. If such a pill cup is used in a pill crushing process, the pestle 11 may be rotated in a grinding motion either with or against the direction of the folds of the flutes without tearing or perforating or other damaging the pill cup. It should further be noted that the pestle and mortar 10 may be adapted for one or two ounce pill cups.

It should further be noted that a handle portion 104 may be frustum-like. The handle portion 104 may be inexpensive and simple to manufacture relative handle portion 60 and is indicated by phantom lines in FIG. 3. The ring-like surface 70 on pill crushing portion 61 is more narrow with handle portion 104.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A pestle and mortar for crushing a pill comprising:

a pestle including a pill crushing portion and a handle portion, the pill crushing portion forming the shape of a frustum and having a planar pill crushing face and a pestle sidewall, the pestle having a central axis; and a mortar having a frustum-shaped receptacle formed by a mortar sidewall and a planar mortar floor, the surface area of the mortar floor being slightly greater than the surface area of the pill crushing face so that the pestle is readily insertable in and removable from the receptacle and so that lateral movement of the pill crushing face across the mortar floor is minimal, the pestle being freely rotatable in the receptacle about the axis whereby the floor of the mortar and face of the pestle cooperate in the crushing of the pill.

2. The pestle and mortar of claim 1, and further comprising a frustum-shaped pill cup having a sidewall and a floor, the mortar sidewall being adjacent to but spaced from a portion of the pill cup sidewall when the pill cup is disposed in the receptacle, the sidewalls of the mortar and pill cup being parallel so that the pill cup forms a lining for the receptacle.

3. The pestle and mortar of claim 2 wherein the pill cup includes a top peripheral edge portion and the mortar receptacle is formed sufficiently deep in the mortar so that the mortar sidewall extends higher than one-half the height of a pill cup sidewall but lower than the top peripheral edge portion whereby the pill cup is stable when disposed in the mortar and the pill cup is readily removable from the mortar by the top peripheral edge portion.

4. The pestle and mortar of claim 1, and further comprising a frustum-shaped pill cup having a sidewall and a floor, the pestle sidewall being adjacent to but spaced from the pill cup sidewall when the pill crushing portion is disposed in the pill cup, the sidewalls of the pestle and pill cup being parallel so that the pill crushing portion of the pestle is nestable in the pill cup.

5. The pestle and mortar of claim 1, wherein the mortar sidewall and pestle sidewall are parallel.

6. The pestle and mortar of claim 1, wherein the height of the pestle sidewall is greater than the height of the mortar sidewall.

7. The pestle and mortar of claim 1, and further comprising a frustum-shaped pill cup with a sidewall and a dimpled floor, the dimpled floor being expandable and thereby expanding the pill cup when pressure is brought to bear on the dimpled floor by the pill crushing portion of the pestle, the pill cup sidewall expanding and bearing against the mortar sidewall when the pill crushing portion brings pressure to bear on the dimpled floor.

8. The pestle and mortar of claim 1, and further comprising a frustum-shaped, one ounce plastic pill cup, the mortar receptacle being formed so as to receive the one ounce plastic pill cup.

9. The pestle and mortar of claim 1, wherein the handle portion includes a ball-shaped end formed opposite the pill crushing portion to concentrate the weight of the pestle in the ball-shaped end and the pill-crushing portion.

10. The pestle and mortar of claim 1, wherein both the pill crushing portion of the pestle and a section of the handle portion form substantially the shape of a frustum.

11. A pill cup, pestle and mortar combination for crushing a pill in the pill cup, comprising:

a frustum-shaped pill cup with a sidewall and a floor, a pestle having a pill crushing portion disposed substantially in the shape of a frustum and also having a planar pill crushing face, the surface area of the pestle face being slightly less than the surface area of the pill cup floor so that, the pestle is nestable in pill cup with minimal lateral movement so as to preclude the pill cup from sticking to the pill crushing portion upon removal of the pill crushing portion from the pill cup; and a mortar having a frustum-shaped pill cup receptacle formed therein by a mortar sidewall and a planar mortar floor, the surface area of the mortar floor being slightly greater than the surface area of the pill cup floor so that the pill cup lines the mortar receptacle with minimal lateral movement so as to preclude the pill cup from sticking to the mortar upon removal of the pill cup from the mortar and so that the mortar and pill cup operate as one piece in a pill crushing operation of the pestle and mortar.

12. A pestle and mortar for crushing a pill, comprising:

a pestle having a frustum-shaped portion with a planar pill crushing face, the pestle having a central axis, and a mortar having a frustum-shaped receptacle with a planar floor, the receptacle conforming substantially to the frustum-shaped portion and pill crushing face, the pestle being freely rotatable in the receptacle about the axis whereby the pestle and mortar cooperate to crush a pill.

13. The pestle of claim 12, and further comprising a frustum-shaped pill cup with a sidewall and a floor, the sidewalls of the pill cup and pestle being parallel and adjacent to but spaced from each other when the frustum-shaped portion is nestled in the pill cup whereby the pestle may simultaneously crush and contain the pill in the pill cup.

14. A pestle for crushing a pill in combination with a frustum-shaped pill cup, comprising:

a frustum-shaped pill cup with a sidewall and a floor forming a pill cup interior, and a pestle having a handle portion and a frustum-shaped pill crushing portion with a sidewall and a planar pill crushing face, the pestle having a vertical axis and being freely rotatable about the vertical axis in the pill cup interior, the pestle also being freely tiltable about a horizontal axis in the pill cup interior the frustum-shaped pill crushing portion conforming substantially to the interior of the pill cup whereby the frustum-shaped pill crushing portion may simultaneously crush and contain the pill in the pill cup.

15. A mortar in combination with a frustum-shaped pill cup having a continuous pill cup sidewall, comprising:

a frustum-shaped pill cup with a sidewall and a floor, and a mortar with a frustum-shaped receptacle formed by a continuous mortar sidewall and a planar floor, the mortar having top and bottom surfaces to define a height of the mortar, the mortar having a curvilinear perimeter, the top surface forming the shape of a circular band and the bottom surface forming the shape of a disk, the mortar being solid from the top to bottom surfaces, from the mortar sidewall to the perimeter, and from the floor of the receptacle to the bottom surface, the height of the mortar sidewall being less than the height of the pill cup sidewall but greater than one-half the height of the pill cup sidewall to deeply and stably receive the pill cup in which a pill may be crushed.

16. A pestle and mortar for crushing a pill comprising:

a pestle including a pill crushing portion and a handle portion, the pill crushing portion being formed substantially in the shape of a frustum so as to include a continuous, substantially frustoconical pestle sidewall and a flat, pill crushing face, the pill crushing portion also including a beveled edge being disposed between the pestle sidewall and the flat, pill crushing face, and a mortar including a frustum-shaped receptacle formed by a continuous mortar sidewall and a flat mortar floor, the height of the mortar sidewall being greater than one-half the height of the pestle sidewall but less than the height of the full length of the pestle sidewall, the surface area of the mortar floor being slightly greater than the surface area of the pestle floor so that the pestle is readily insertable in and removable from the mortar with minimal lateral movement relative the mortar, the continuous mortar sidewall being parallel and adjacent to but spaced from the pestle sidewall to further minimize lateral movement between the pestle and the mortar whereby the pill is crushed in the mortar by a rotating grinding motion applied to the handle portion.

17. The pestle and mortar of claim 16, and further comprising a frustum-shaped pill cup with a sidewall and a floor, the sidewalls of the pestle, mortar, and pill cup being generally parallel so that the pill cup is nestable between the pestle and mortar.

* * * * *